United States Patent [19]

Drage

[11] 4,306,592

[45] Dec. 22, 1981

[54] METHOD OF AND TOOL FOR USE IN APPLYING SOFT WIRE CLAMPS TO FLEXIBLE TUBING

[76] Inventor: Sergey Drage, R.F.D. 1, Box 261, Dresden, Me. 04342

[21] Appl. No.: 125,706

[22] Filed: Feb. 28, 1980

[51] Int. Cl.[3] ..... B25B 27/10

[52] U.S. Cl. ..... 140/123.5; 81/9.3

[58] Field of Search ..... 140/123.5, 93.2; 81/9.3

[56] References Cited

U.S. PATENT DOCUMENTS

| | | | |
|---|---|---|---|
| 2,156,187 | 4/1939 | Medved | 81/9.3 |
| 2,494,963 | 1/1950 | Ray | 81/9.3 |
| 2,600,394 | 6/1952 | Conklin | 81/9.3 |
| 3,209,626 | 10/1965 | Shumaker | 81/9.3 |
| 3,800,836 | 4/1974 | Flick | 140/93.2 |
| 4,084,625 | 4/1978 | Brinegar | 140/123.5 |

*Primary Examiner*—Gil Weidenfeld
*Assistant Examiner*—K. J. Ramsey

[57] ABSTRACT

A tool for use in applying a soft steel wire clamp, having a hook at one wire end through which the tail end of the wire extends to form an constrictable annulus of at least one loop, has a nose portion for engaging the wire loop, a lengthwise channel extending rearward of the nose portion in alignment with a bore in the rear portion to enable the tail to be gripped by a pulling device for constricting the loop, and a hook engaging pawl pivotally mounted in a position to swing along a path over the channel from a first remote position into a fixed position close thereto; whereby, with the tail of a clamp extending lengthwise of the channel and through the bore and the loop portion adjacent the hook in engagement with the tip of the nose portion, the actuation of the pulling device, while contracting the loop, causes relative arcuate movement between the loop and the tail such that the proximate portion of the tail is lifted from the channel and bends about the hook whereupon further actuation of the pulling device the pawl engages the hook forcing it and the displaced tail portion back into the channel to complete the formation of a clamp lock about the hook and the rupturing of the tail substantially at the lock.

22 Claims, 15 Drawing Figures

Fig. 10
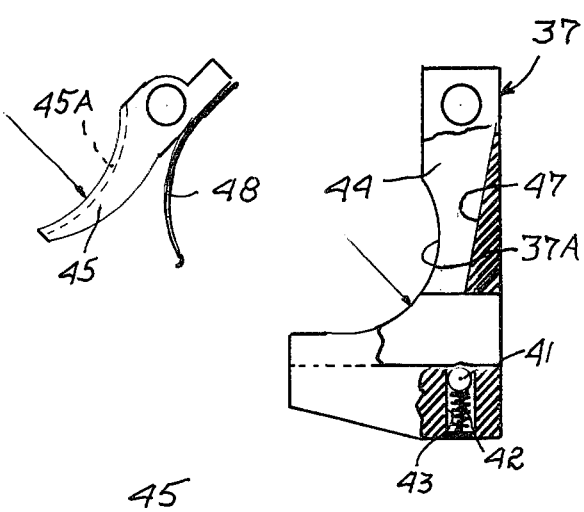
Fig. 9
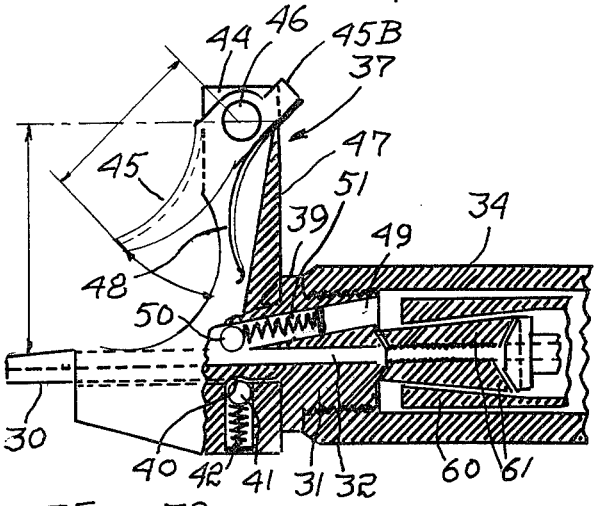
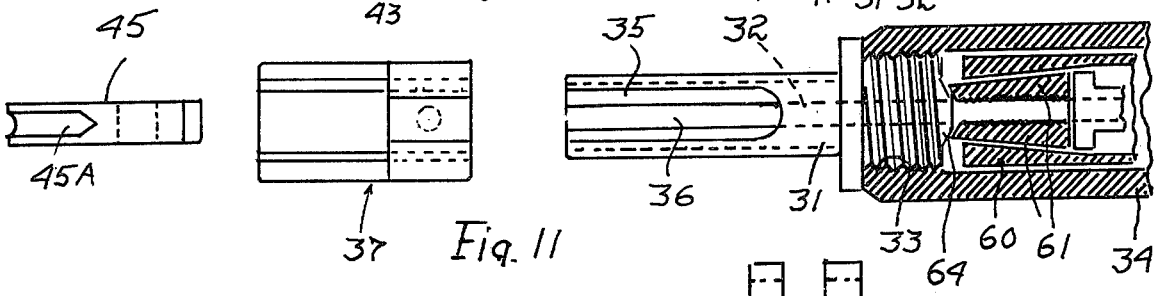
Fig. 11
Fig. 12
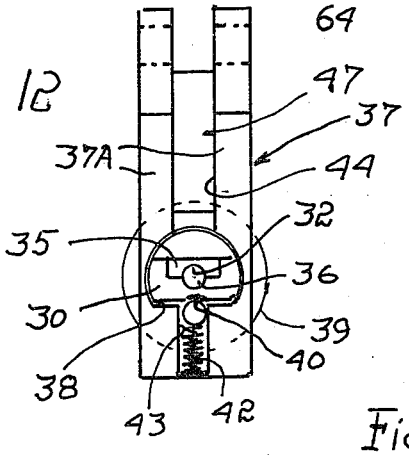
Fig. 13
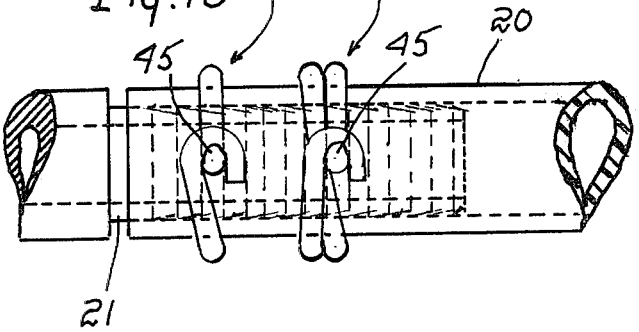
Fig. 14
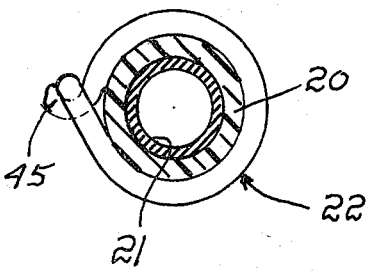

METHOD OF AND TOOL FOR USE IN APPLYING SOFT WIRE CLAMPS TO FLEXIBLE TUBING

BACKGROUND REFERENCES

U.S. Pat. No. 4,084,625
U.S. Pat. No. 3,800,836
U.S. Pat. No. 3,209,626
U.S. Pat. No. 2,600,394
U.S. Pat. No. 2,494,963
U.S. Pat. No. 2,156,187

BACKGROUND OF THE INVENTION

Flexible tubing is widely used in conduits for various liquids and gases with ends fitted on fixed metal conduit components. While such tubing is sufficiently pliable to enable ends to be forced over the ends of such components, it is the usual practice to use clamps which, when tightened about the fitted tubing ends ensure their retention and that the thus established joints are leakproof even if the fluid in the conduit is under a substantial pressure.

Such tubing is available in a wide range of sizes and while the invention is concerned with thus formed joints regardless of the tubing diameter and of the materials of which the tubing is formed, it is herein discussed primarily with reference to flexible plastic tubing commonly used for various types of plumbing and other procedures both because it is inexpensive and because it is easy to work with.

Establishing leakproof connections with such tubing is often difficult because there are substantial variations in the inside diameters of tubing of a particular size, one-half inch tubing as one example and the size most commonly used. Where the inside diameter of such tubing is oversize or where conduit pressures are a factor, conventional clamps often cannot apply enough compression to make the joint leakproof because such conventional clamps utilize flat metal strapping.

THE PRESENT INVENTION

The present invention is concerned with the application of soft steel wire clamps to flexible conduits to secure the ends thereof to tubular members on which they are fitted, each clamp having at least one loop through which the conduit extends and a hook at one end through which the other end extends as a tail.

The general objective of the present invention is to provide a method of and a tool for use in applying such a clamp to enable it to be constricted about the tubing under sufficient tension to ensure against leakage, form a clamp lock about the hook of the clamp, and remove the excess wire all as part of a single operation, that of pulling the tail to place the wire under a constantly increasing tension.

In accordance with the invention, this general objective is attained, in terms of the tool, with a tool including a forward nose portion and a rear portion. The nose portion has a lengthwise channel for the tail of a clamp in alignment with a bore in the rear portion which may be an adapter attachable to a device having means by which the tail wire may be gripped and pulled or it may be an integral part of such a device. The tool is provided with a pawl pivotally mounted to swing over the channel from a first remote position into a fixed position close thereto. With a clamp in place with its tail extending along the channel, through the bore and gripped by the pulling device and the tail between the loop and the pawl, a pull on the tail with increasing tension first brings the hook into engagement with the tip of the nose, the pull effecting the contraction of the loop, such movement of the tool relative to the clamp as, in effect, to swing the loop about the nose through an arc such that the portion of the tail adjacent the hook is lifted from the channel and partially bent about the hook, the pawl then engaging the hook and pulled thereby into its second position with the lifted tail portion returned to the channel and the bending of the tail continued to complete a clamp lock with the tail rupturing substantially at the clamp lock when the breaking stress of the wire is exceeded all as a consequence of the continued operation of the pulling means.

From the foregoing it will be apparent that the invention, in terms of method, consists of the steps, with the clamp in place, of pulling the tail along a predetermined path to contract the loop while first holding the hook until the pulling force, in effect, causes the loop to swing through an arc while first displacing the portion of the tail adjacent the hook to bend the tail partially about the hook, then again re-engaging the hook to force the hook into a position in which the tail is so bent about the hook as to form a clamp lock with the displaced tail portion returned to the channel, the tail rupturing close to the clamp lock when its breaking stress is attained as a consequence of the increased tension resulting from the continued pull on the tail.

Other objectives of the invention and the means effecting their attainment will be apparent from the following description of the preferred embodiment and the appended claims.

BRIEF DESCRIPTION OF THE DRAWINGS

The accompanying drawings illustrate the preferred embodiment of the invention with FIG. 1 is a side elevation of a single loop clamp;

FIG. 9 is a side view of the working end of the tool;

FIG. 10 is a side view of the pawl and its mount;

FIG. 11 is an exploded plan view of the working end of the tool;

FIG. 12 is a view thereof as seen from the front of the tool;

FIG. 13 is a fragmentary view of a joint provided with both a single and a double loop clamp;

FIG. 14 is an end view thereof; and

THE PREFERRED EMBODIMENTS OF THE INVENTION

Figure 1:
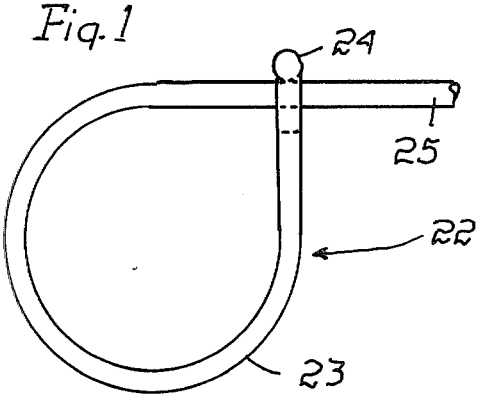
Figure 2:
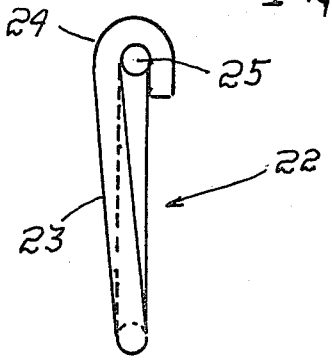
FIG. 2 is an edge view thereof.
Figure 3:
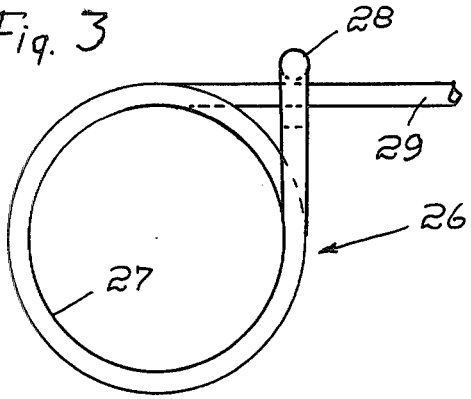
FIG. 3 is a side elevation of a double loop clamp.
Figure 4:
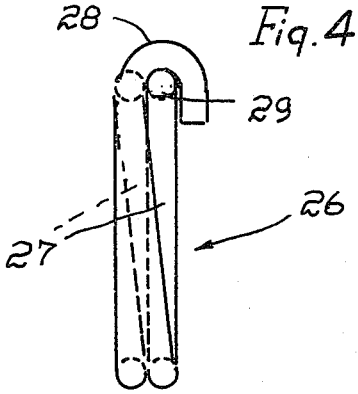
FIG. 4 is an edge view thereof.
Figure 5:
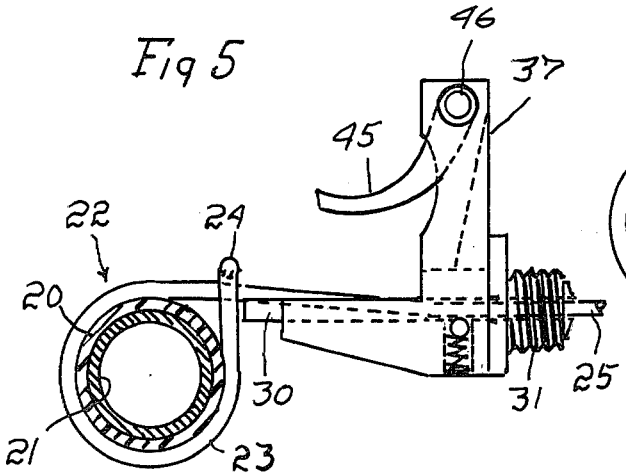
FIG. 5 is a somewhat schematic side view of the tool illustrating the initiation of the contraction of the loop or loops as the first function of the pulling of the tail of a clamp.
Figure 6:
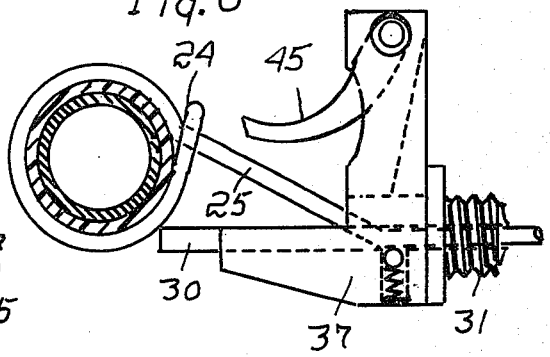
FIG. 6 is a like view illustrating the start of the second function of the tail pulling; namely, the formation of the clamp lock.
Figure 7:
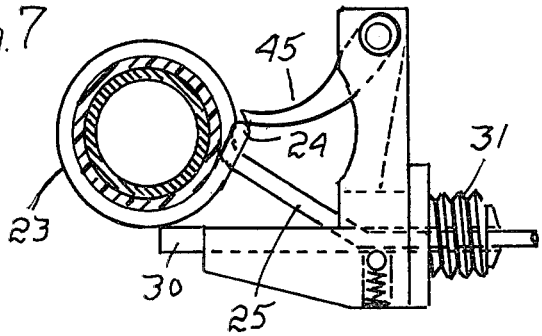
FIG. 7 is another like view illustrating the further development of the clamp lock.
Figure 8:
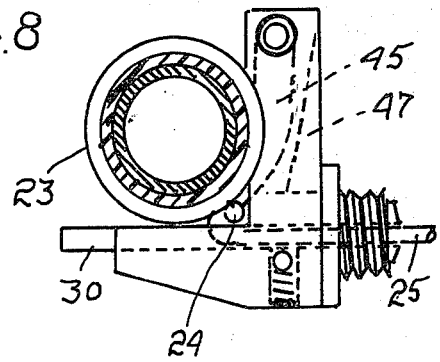
FIG. 8 is yet another like view illustrating the completion of the clamp lock with the tail about to rupture when the pulling tension is further increased.

In order that an end of a length 20 of pliable flexible tubing, plastic or rubber, may be clamped to a fitting 21 on which it is a push fit, see FIGS. 13 and 14, a clamp generally indicated at 22 in FIGS. 1 and 2 is provided. Such a clamp is easily formed from a length of soft steel wire to provide a loop 23 dimensioned to fit freely on the tubing 20 with one end bent to establish a hook 24 and the other end extending through the hook 24 as a relatively long tail 25. The clamp generally indicated at 26 in FIGS. 3 and 4 may also be used and it differs only in that it has two loops 27 between its hook 28 and tail 29 and either clamp may be completed about a joint or slipped onto the tubing 20 before it is forced onto the fitting.

FIGS. 5–8 illustrate the essential components of the tool and the functions thereof performed in accordance with the invention; namely, contracting of the loop of a clamp so that it securely anchors the tubing 20 to the fitting 21 under such tension as to prevent failure, locking the tail to the hook and removing the excess wire, all as part of one operation and effected by pulling the tail using means affording such substantial mechanical advantage as to enable the breaking stress of the wire to be easily attained. While the pulling means may be of a type in which the pulling force is constantly applied and continuously increased it is shown, see FIG. 15, as of a type in which the pulling force, while continuously increased, is intermittently applied.

The part of the tool engaged by a clamp as it is being applied has, see FIGS. 9–12, a forwardly disposed portion 30 and a rear portion 31. The rear portion 31 has a tail-receiving bore 32 which has its end exteriorly threaded to enable it to be screwed into the threaded entrance 33 of the tubular housing 34 of that portion of the tool, see FIGS. 9 and 11 into which the tail of a clamp is to be entered and then gripped and pulled.

The nose portion 30 has a flat upper surface provided with a channel 35 of a width such as to accommodate the loop or loops of a clamp and a narrow tail-receiving bottom channel 36 with which the bore 32 of the rear portion 31 is aligned.

A mount 37 has a bore 38 shaped and dimensioned to enable it to be slipped over the nose portion 30 and seated against a stop 39 with which the rear portion 31 is provided and then be locked in place. For that purpose, see FIGS. 9, 10, and 12, the rear member 31 is notched as at 40 forwardly of the stop 39 to receive the portion of a ball 41 that is exposed in the bore 38. The ball 41 is backed by a spring 42 held captive in a bore 43 in the mount 37 thus enabling the mount 37 to be easily removed and replaced.

The mount 37 has an upwardly opening slot 44 dimensioned to accommodate an arcuate pawl 45 having a lengthwise groove 45A and held therein by a pivot 46 enabling it to swing along a path over the channel 35 between a first forward position spaced therefrom but downwardly inclined and a second position within the mount 37 with its free end close to the channel 35 with the pawl 45 then backed by a stop 47 within the slot 44 which stop also serves to back the free end of a leaf spring 48 secured to that portion 45B of the pawl that extends beyond the pivot 46. The upper end of the stop 47 is engaged by the rear portion 45B to establish the first position of the pawl 45. The forward edges of the mount 37 are formed with arcuate recesses 37A of the same dimensions as the pawl 45 which are in alignment therewith in its second position. The curvature of the pawl is determined by the size of the tubing in order that the mount 37 may fit against a portion of the tubing 20. As the mount 37 is easily removed, if the tool is to be used with tubing of a different size, it may be replaced by a like mount appropriate for use therewith, the curvature of the pawl, its recesses and the spacing of the pivot of the pawl from the channel 34 determined by the outside diameter of the tubing then to be provided with clamps.

With the loop of a clamp, the clamp 22, for example, placed on the tubing 20, the tubing 20 then forced over the fitting 21 and the clamp 22 positioned to overlie the fitting 21 and the clamp 22 positioned to overlie the fitting, the tail 25, see FIGS. 5–8, is inserted lengthwise of the channel 36 and through the bore 32 with the hook 24 in position to contact the tip of the nose portion 30 and with the tail 25 between the loop and the pawl 41. With the tail 25 caught by the pulling means, later to be described in connection with FIG. 15, by which the tail 25 is drawn, the loop 23 starts to contract with movement of the tool relative to the tubing in effect pulling the tubing over the nose and swinging through an arc of approximately 180° with the portion of the tail 25 adjacent the hook 24 being lifted from the channels 35 and 36 and partially bent about the hook 24. The swinging loop causes the tip of the pawl 45 to be engaged by the hook 24 and be forced downwardly into its second position to return the displaced tail portion into the channel 35 and to complete the bending of the tail about the hook 25 to form a clamp lock 48, see FIGS. 13 and 14. Continued pulling on the tail 25 results in tension thereon increasing until the tail ruptures closely adjacent the clamp lock 48.

The preferred soft steel wire size is 14 gauge, particularly with one-half inch tubing which is the most widely used size. Such wire has a breaking stress in the order of 500 pounds which is substantially the tension applied by a completed clamp to the tubing 20.

Figure 15:
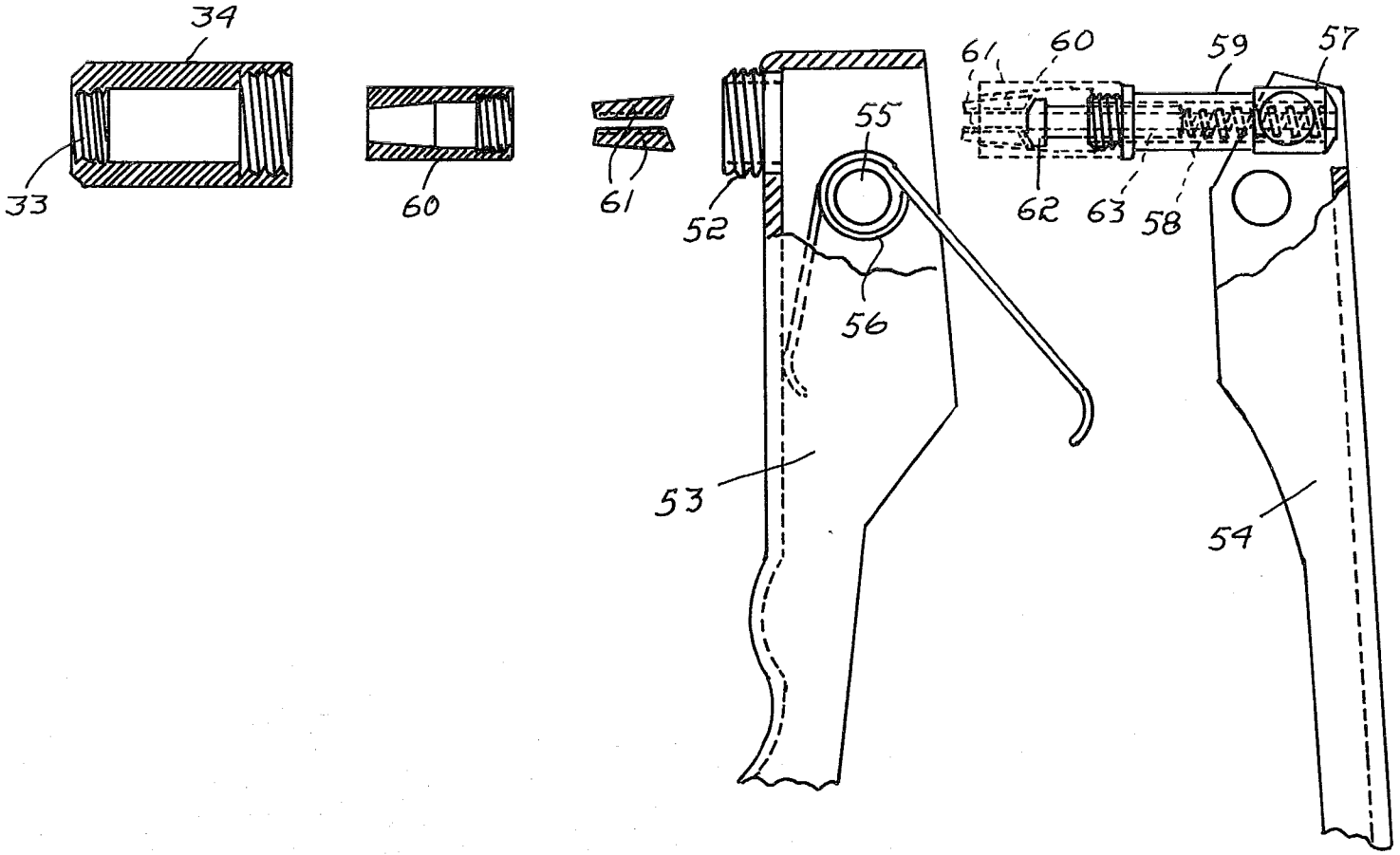
FIG. 15 is an exploded view of the wire pulling device.

The pulling part of the tool, see FIG. 15, is shown as of a well known type manufactured by U S M Corporation and often referred to as a "pop-rivet" tool but modified as required by the present invention. As a "pop-rivet" tool intermittently releases the gripped work, the rear portion 31 has a forwardly and inwardly inclined bore 49 opening into the bore 32 to partially expose a locking ball 50 backed by a spring 51 held captive in the bore 49. While the tail 25 is free to move in the direction it is pulled, the spring backed ball 50 locks the tail from moving in the opposite, tension-releasing direction.

The housing 34 is threaded on a bushing 52 that is a press fit in a bore in the upper end of a first handle 53 which is U-shaped in cross section and dimensioned to accommodate the upper end of a second handle 54 which is also U-shaped in cross section. The two handles are interconnected by a pivot 55 which confines the coil spring 56, each end of which engages the appropriate one of the handles to maintain them yieldably spread apart.

A swivel 57 in the upper end of the second handle 53 backs one end of a spring 58 in the rear part of tubular holder 59 attached to the swivel 57. A tubular housing 60, a free fit in the housing 34, see FIGS. 9 and 11, accommodates a pair of jaws 61 and is threaded on the front end of the holder 59, see FIG. 15. The forward part of the jaw housing 60 tapers inwardly and the rear ends of the jaws define a concavity of the size and shape of the head 62 of a tubular actuator 63 slidably entrant of the holder 59 is in engagement with the spring 58.

When the handles 53 and 54 are in their normal, spread-apart relationship, the jaws 61 are held open by the boss 64 of the rear portion 31 so that the tail 25 may be entered through the housing 34 but when the handles are drawn together, the jaw housing 60 is pulled rearwardly with the actuator 63 being urged forwardly as the spring 58 is compressed thereby wedging the jaws 61 into gripping relationship with the tail 25 and pulling the tail 25 a short distance. Repeated operation of the handle results in the several functions; namely, the contraction of the clamp, the forming of the clamp lock 45, and the rupturing of the tail wire. It should be noted that the swivel 57 has a bore 65 enabling the tail wire to pass therethrough.

From the foregoing, it will be apparent that, in accordance with the invention, soft steel wire clamps can be quickly and easily applied to ensure leakproof joints between pliable tubing and fittings.

I claim:

1. A tool for use in clamping an end of a length of pliable, flexible tubing against a tubular member over which an end is fitted using a clamp of a soft steel wire having at least one loop through which the tubing extends and an end in the form of a hook through which the other end extends as a tail, said tool including a forward nose portion having a lengthwise channel, a rearward portion having a tail-receiving bore, a pawl overlying said channel and a pivotal connection between said pawl and one of said portions adjacent the rear end of said channel enabling said pawl to swing along a path in alignment with said channel from a first forward position in which its free end is remote therefrom into a second fixed position in which said pawl end is close to the rear end of said channel, and means connected to said rearward portion operable to grip and pull the tail of a clamp when disposed with its hook engageable with the tip of the nose, its tail extending along said channel through the bore of said rearward portion and into said means, and its loop in the plane of said pawl path and channel but with said tail between it and said pawl whereby actuation of said pulling means is attended by the contraction of the loop as the tail lengthens, relative movement between the tool and the clamp swinging the loop about the nose with the pawl end engaging the hook and forcing of the pawl into its second position then to serve as a stop against which the loop seats, the tail bending about the hook to provide a clamp lock and finally the tail rupturing substantially at said lock.

2. The tool of claim 1 in which the pulling means, when operated, alternately pulls and releases said tail and the rearward portion includes means holding said tail from moving in a tension-releasing direction when the tail is released.

3. The tool of claim 2 in which the rearward portion has a forwardly inclined bore opening into the tail-receiving bore, and the tail holding means is a ball held in the inclined bore partially exposed position in the tail-receiving bore, and a spring yieldably holding said ball in said position thereby to lock the tail from moving in a tension-releasing direction.

4. The tool of claim 1 in which the nose portion has a lengthwise channel of sufficient width to accommodate a plurality of loops and the tail-receiving channel extends lengthwise of the loop-receiving channel.

5. The tool of claim 1 in which the connection between the pawl and said one tool portion is a mount having a slot in alignment with said channel, said mount includes a stop, said pawl pivotally connected to said mount and including an end portion engageable with said stop to establish the first pawl position, and spring means yieldably urging said pawl outwardly and upwardly to effect engagement of said pawl end portion with said stop.

6. The tool of claim 5 in which the spring is a leaf spring one end of which is secured to the end portion of the pawl with its other end in engagement with said stop.

7. The tool of claim 6 in which the stop is also engaged by the pawl when in its second position.

8. The tool of claim 5 in which the pawl is arcuately recessed and of the radius substantially that of the outside of the loop when contracted about the tubing and the sides of the mount are similarly recessed and the pawl and mount recesses register in the second position of the pawl thereby to enable the mount to be held substantially against the tubings.

9. The tool of claim 8 in which the mount is detachably attached to said one portion.

10. The tool of claim 8 in which said one portion has a rearward stop and has a notch forwardly thereof, and the mount has a bore dimensioned to receive said one portion and a detent releasably engaging with said notch when said mount is seated against said stop thereby to enable a mount and pawl for use with tubing of one size to be removed and replaced by a like mount and pawl, the pawl and mount recesses of a radius appropriate for tubing of a different size.

11. A tool for use in clamping an end of a length of pliable, flexible tubing against a tubular member over which an end is fitted using a soft steel wire clamp having at least one loop through which the tubing extends and an end in the form of a hook through which the other end extends as a tail, said tool comprising an attachment for a pulling device having a removable part having a port, said tool including a forward nose portion having a lengthwise channel a rearward portion having a tail-receiving bore and attachable to the pulling device in substitution for the removable part thereof, a pawl overlying said channel, and a pivotal connection between said pawl and one of said portions adjacent the rear end of the channel and enabling the pawl to swing along a path in alignment with said channel from a first forward position in which its free end is remote therefrom into a second fixed position in which said pawl end is close to the rear end of said channel, whereby said tool when attached to said device with a clamp disposed about a tubing end with its hook engageable with the tip of the nose portion, its tail extending along said channel, through the bore of the rearward portion and into said device with the loop of the clamp in the plane of the pawl but with the tail between it and said pawl, the actuation of the device is attended by the contraction of the loop, relative movement between the tool and the clamp swinging the loop about the nose with the pawl end engaging the hook and forcing the pawl into its second position, the tail bending about the hook to provide a clamp lock and the tail rupturing substantially at the lock.

12. The tool of claim 11 in which the device is of the type intermittently engaging and pulling the tail and the rearward portion includes means holding said tail from moving in a tension-releasing direction.

13. The tool of claim 12 in which the device has clamping jaws, operator controlled means to effect their clamping relationship and said removable part has an end shaped and dimensioned to normally hold the clamping jaws spaced apart to receive the tail, and said rearward tool portion includes an end that is also shaped and dimensioned to hold the clamping jaws spaced apart.

14. The tool of claim 11 in which the nose portion has a lengthwise channel of sufficient width to accommodate a plurality of loops and the tail-receiving channel extends lengthwise of the loop-receiving channel.

15. The tool of claim 11 in which the connection between the pawl and said one tool portion is a mount having a slot in alignment with said channel, said mount includes a stop, said pawl pivotally connected to said mount and including an end portion engageable with said stop to establish the first pawl position, and spring means yieldably urging said pawl outwardly and upwardly to effect engagement of said pawl end portion with said stop.

16. The tool of claim 15 in which the spring is a leaf spring one end of which is secured to the end portion of the pawl with its other end in engagement with said stop.

17. The tool of claim 16 in which the stop is also engaged by the pawl when in its second position.

18. The tool of claim 15 in which the pawl is arcuately recessed and of the radius substantially that of the outside of the loop when contracted about the tubing and the sides of the mount are similarly recessed and the pawl and mount recesses register in the second position of the pawl thereby to enable the mount to be held substantially against the tubings.

19. The tool of claim 18 in which said one portion has a rearward stop and has a notch forwardly thereof, and the mount has a bore dimensioned to receive said one portion and a detent releasably engaging with said notch when said mount is seated against said stop thereby to enable a mount and pawl for use with tubing of one size to be removed and replaced by a like mount and pawl, the pawl and mount recesses of a radius appropriate for tubing of a different size.

20. The method of clamping an end of deformable and flexible tubing against a tubular member over which it is fitted with a clamp of a soft steel wire having at least one loop through which the other end of the wire extends as a tail, said method consisting of the steps of first pulling the tail along a predetermined path while first holding the hook against movement thereby to partially contract the loop, then forcing the loop to swing through a major arc to partially bend the tail about the hook with a portion of the tail adjacent the loop displaced from said path, then holding the hook to force said tail portion into said path as the loop completes its travel to complete the tensioning of the loop and the bending of said tail about the hook to form a clamp lock, and continuing the pulling of the tail until it ruptures substantially at the thus established lock.

21. The method of claim 20 in which the pulling of the tail is effected by alternately pulling the tail and releasing it and the additional step of holding the tail in a tension-releasing direction.

22. The method of claim 20 in which the breaking stress of the wire is substantially the stress applied to the loop.

* * * * *